United States Patent [19]

Wakao

[11] Patent Number: 4,655,691

[45] Date of Patent: Apr. 7, 1987

[54] TEMPERATURE-DIFFERENCE-ACTUATED PUMP EMPLOYING NONELECTRICAL VALVES

[75] Inventor: Noriaki Wakao, Kanagawa, Japan

[73] Assignee: Nippon Mining Co., Ltd., Japan; a part interest

[21] Appl. No.: 895,575

[22] Filed: Aug. 12, 1986

Related U.S. Application Data

[63] Continuation of Ser. No. 702,102, Feb. 15, 1985, abandoned.

[30] Foreign Application Priority Data

Feb. 17, 1984 [JP] Japan ..... 59-27192

[51] Int. Cl.[4] ..... F04B 9/00; F04B 47/04

[52] U.S. Cl. ..... 417/122; 417/379; 60/667; 60/691

[58] Field of Search ..... 417/379, 388, 122; 60/667, 691.8, 691.11, 691.12

[56] References Cited

U.S. PATENT DOCUMENTS 2,553,276 5/1951 Reed ..... 417/122
2,807,215 9/1957 Hawxhurst ..... 417/388
3,937,599 2/1976 Thureau et al. ..... 417/379 X
4,030,302 6/1977 Mankouski ..... 60/667
4,110,986 9/1978 Tacchi ..... 60/641.8

FOREIGN PATENT DOCUMENTS 2733995 2/1979 Fed. Rep. of Germany ..... 60/641.8
2842181 4/1980 Fed. Rep. of Germany ..... 417/379

*Primary Examiner*—Leonard E. Smith
*Attorney, Agent, or Firm*—Sughrue, Mion, Zinn, Macpeak, and Seas

[57] ABSTRACT

A temperature-difference-actuated pump is disclosed which does not require the use of electrically operated solenoid valves or the like, making the inventive pump especially useful in locations where electricity is not readily available. Either one or two pump chambers is provided, in which is disposed a pumping element such as a flexible bag or piston. One side of each chamber is connected selectively to a boiler or condenser through a mechanically operated switch deriving its working power from the pumping element. The other side of the chamber is utilized to provide the pumping action, either directly or via a noncondensable fluid.

9 Claims, 7 Drawing Figures

TEMPERATURE-DIFFERENCE-ACTUATED PUMP EMPLOYING NONELECTRICAL VALVES

This is a continuation of application Ser. No. 702,102, filed Feb. 15, 1985, now abandoned.

BACKGROUND OF THE INVENTION

The present invention relates to a temperature-difference-actuated pump, particularly, to such a pump operating from a low-level heat source such as solar heat or an effluent from an industrial plant or the like. Such pumps are particularly well suited for use in developing countries, especially in agricultural uses such as for pumping irrigating water, where other energy sources may not be readily available. Yet more specifically, the invention relates to such a pump which requires the use of no electrical valves, making it particularly useful in such applications.

The present applicant has proposed such a pump for converting the energy of low-level sources such as mentioned above into potential energy in the form of raised water supply. (See *Kagaku Kogaku Ronbunshu* (Japan), Vol. 9, No. 6, pp. 698–700, Nov. 1983). Such a pump is shown schematically in FIG. 1.

In FIG. 1, reference character A identifies a boiler; B, a condenser; C, a pumping chamber of constant volume; D, an inflatable bag provided inside the chamber C; E, F and I, electrically operated solenoid valves; G and H, non-return valves; X, a supply tank; and Y, a receiving tank.

This pump operates as follows: An working fluid, which may be a common refrigerant such as FREON, then contained in the boiler A is therein heated by the low-level heating source to cause it to evaporate. Suppose the pressure of the chamber C (space around the bag D) is as low as that of the condenser B, and the bag D is filled with water. The valve F is opened and the remaining valves closed. Vaper of the working fluid passes through the valve F and goes into the space in the chamber C around the bag D. The bag D is squeezed and the water in the bag D is lifted to the receiving tank Y through the non-return valve H. The valve F is then closed and the valve I opened. The working fluid then is condensed in the condenser B, lowering the pressure in the chamber C and thus causing the bag D to expand, sucking in water from the supply tank X through the non-return valve G. The valve I is closed and the valve F is opened again so that the water filled bag D is squeezed and the water is again lifted to the receiving tank Y. This water-lift cycle is repeated with a considerable amount of condensed working fluid accumulated in the condenser B. The valve E is then opened to permit the condensed liquid to flow into the boiler A. The valve F is then opened again and the process repeated.

A modification of the pump of FIG. 1 is shown in FIG. 2. In this modification, the outlet of the bag D is communicated through a pipe J to a closed tank K. The tank K provided with a non-return valve L is immersed in the supply tank X and connected to the receiving tank Y through a pipe N and a non-return valve M. This pump operates substantially in the same manner as that depicted in FIG. 1 except that air is used as a working medium in the bag D. Using the same cycle explained above, the air expelled from and sucked into the bag D performs a pumping action by expelling water from and sucking water into the closed tank K.

In both the pumps of FIGS. 1 and 2, electrically operated solenoid valves are required. In some areas of developing countries, for instance, electricity is not readily available, and in such situations, these pumps are useless.

SUMMARY OF THE INVENTION

Accordingly, it is an object of the present invention to provide a temperature-difference-actuated pump, particularly, such a pump capable of operating from a low-level heat source, which requires no electrically operated components such as solenoid valves.

It is a further object of the present invention to provide such a temperature-difference-actuated pump which is suitable for use in pumping water such as for agricultural uses or for providing a source of potential energy that may be used, for instance, for generation of electricity.

These, as well as other objects of the present invention, are met by a temperature-difference-actuated pump comprising: a boiler supplied with a working fluid; a condenser; a pump chamber; a pumping element disposed in the pump chamber; means for connecting the pump chamber to a source of a fluid to be pumped and a receiving receptacle in such a manner that repetitive movement of the pumping elememt pumps the fluid to be pumped from the source to the receptacle; valve means connecting the boiler, condenser and pump chamber to one another for controlling the flow of the working fluid among the boiler, condenser and pump; and means for operating the valve means in response to pressure changes in the pump chamber.

DESCRIPTION OF THE PREFERRED EMBODIMENTS

A first preferred embodiment of a temperature-difference-actuated pump of the invention will be described with reference to FIG. 3 of the drawings. In this and the subsequently described embodiments, it is assumed that the heat source is a solar heat and that the pump is employed to transport water from a lower supply tank to an upper receiving tank.

Figure 3:
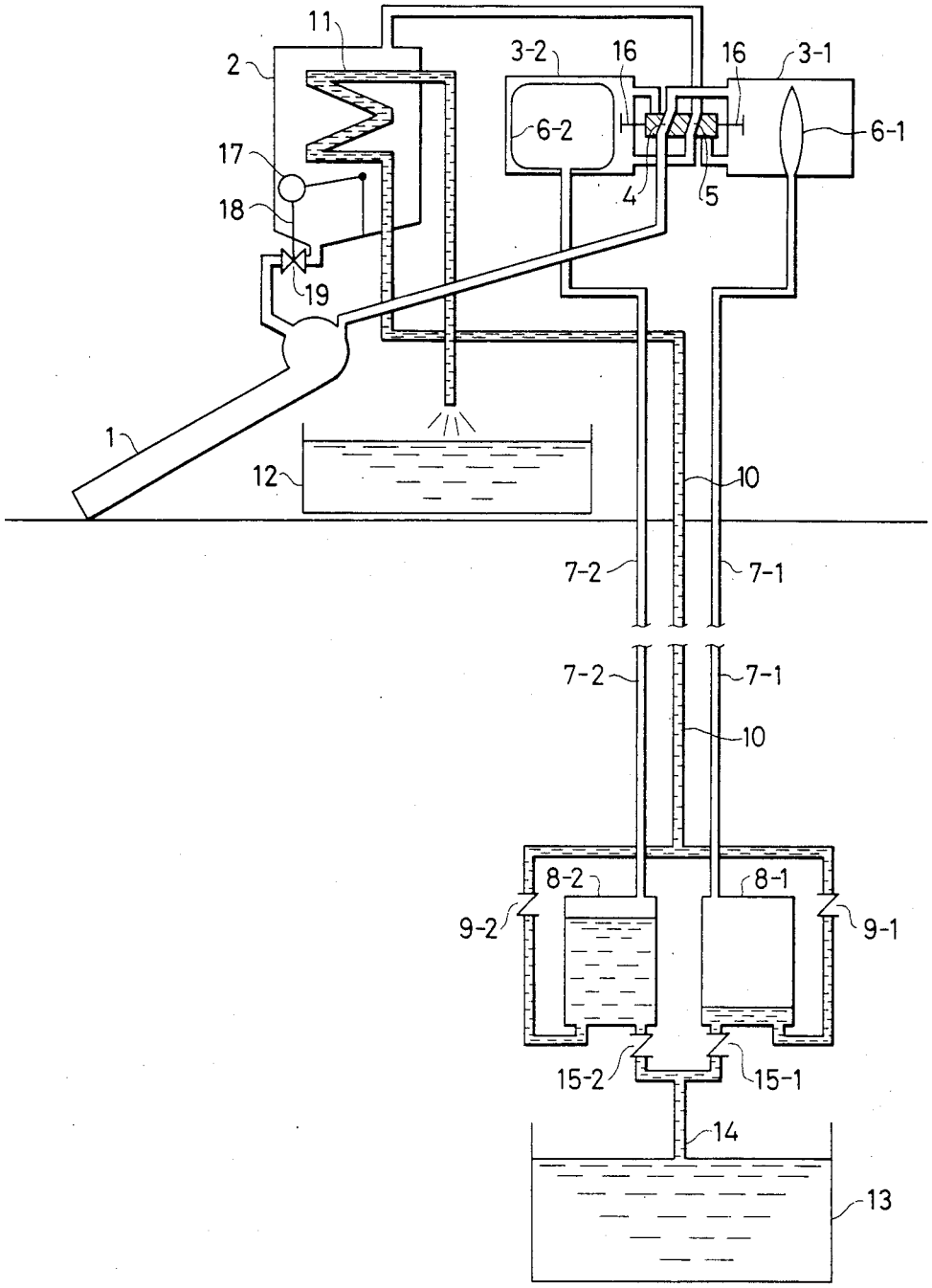
FIG. 3 is a schematic diagram of a first embodiment of a temperature-difference-actuated pump of the invention, applied to a gas-compression pump having two bag-type pump chambers.

In the embodiment of FIG. 3, the pump is provided with two pump chambers 3-1 and 3-2 in which are disposed respective bags 6-1 and 6-2. The bags 6-1 and 6-2 are made of a gas-tight flexible material and are filled with a noncondensable gas such as air. The interiors of the bags 6-1 and 6-2 are communicated with respective tanks 8-1 and 8-2 through pipes 7-1 and 7-2. Both tanks 8-1 and 8-2 are communicated with a supply tank 13 via respective non-return valves 15-1 and 15-2 and a common pipe 14. The tanks 8-1 and 8-2 are further connected via a water pipe 10 to a cooling coil 11 of a condenser 2. The outlet of the cooling coil 11 is at a receiving tank 12 at a higher level than the supply tank 13. The working chamber of the condenser 2 is selectively connected with the pump chambers 3-1 and 3-2 via a valve 5. Similarly, the outlet of a boiler 1, which is here a solar heater containing a working fluid such as the refrigerant FREON, is selectively connected to the pump chambers 3-1 and 3-2 via a valve 4. The valves 4 and 5 are linked together via an operating shaft 16, the ends of which can be pressed upon by the bags 6-1 and 6-2 as they are being inflated. The valves 4 and 5 are arranged such that when the outlet of the boiler 1 is connected to one of the chambers 3-1 and 3-2, the outlet of the condenser 2 is connected to the other one of the two chambers, and vice versa.

Figure 1:
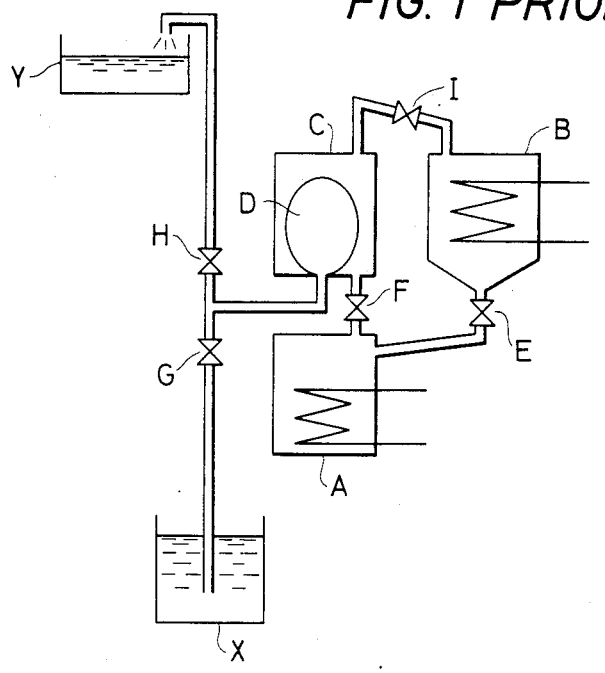
FIG. 1 PRIOR ART
FIGS. 1 and 2 show schematically prior art temperature-difference-actuated pumps of the same general type to which the invention pertains but employing electrically operated solenoid valves.
Figure 2:
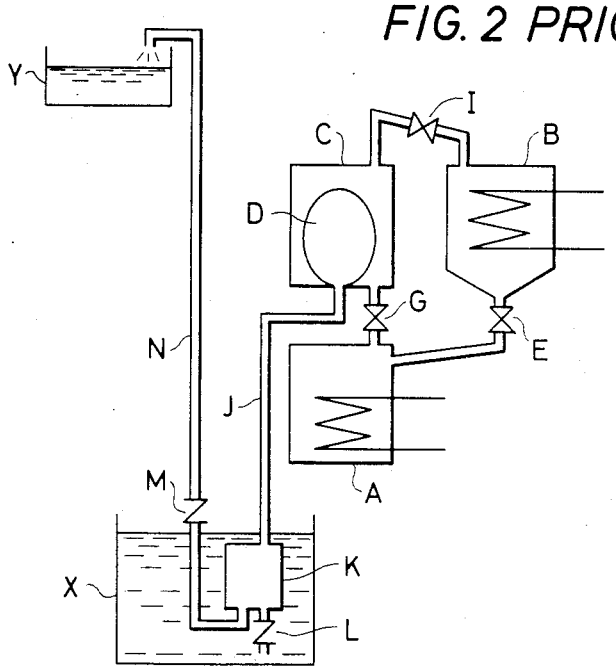
FIG. 2 PRIOR ART

In operation, it is first assumed that the valves 4 and 5 are in the states shown in FIG. 3 connecting the chamber 3-1 to the outlet of the boiler 1 and the chamber 3-2 to the outlet of the condenser 2. Accordingly, high pressure vaporized working fluid from the boiler 1 causes the bag 6-1 to contract, squeezing out the air therefrom. The air from the bag 6-1 forces water out of the tank 8-1, causing it to flow through the non-return valve 9-1 and the pipe 10 to the cooling coil 11 of the condenser 2, from which it is exhausted to the tank 12. The flow of water through the coil 11 produces a cooling effect on the working fluid which flows thereinto through the valve 5 from the chamber 3-2, thus allowing expansion of the bag 6-2. When the bag 6-2 expands, water is sucked into the tank 8-2 from the supply tank 13 through the pipe 14 and the non-return valve 15-2. The working fluid condensed in the condenser 2 flows back to the boiler 1. The expansion of the bag 6-2 causes the operating rod 16 to be pushed to the right in the drawing, changing the positions of the valves 4 and 5 so that the chamber 3-1 is communicated with the condenser 2 and the chamber 3-2 with the boiler 1. In this state, the above-described operations are repeated but with the functions of the chambers 3-1 and 3-2 and their associated components reversed. In this manner, water is pumped from the supply tank 13 to the receiving tank 12 without the use of elecrically operated valves or components of any kind. This embodiment does have the advantage that, since it does not suck water, the vertical distance between the tank 13 and the pump chambers 3-1 and 3-2 is not limited to approximately 10 meters as in the case of the embodiment of FIG. 1 which relies upon atmospheric pressure to push the water through the pipes.

Figure 4:
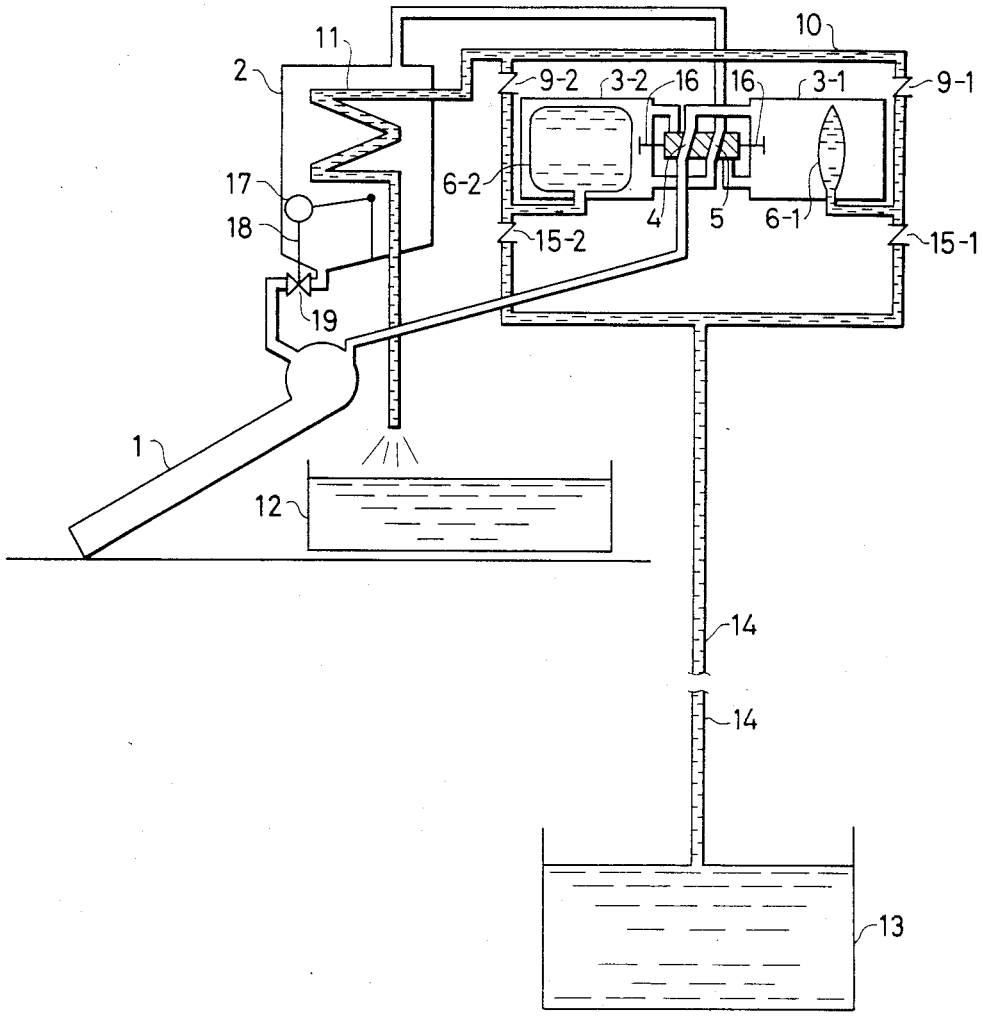
FIG. 4 is a schematic diagram of a second embodiment of a temperature-difference-actuated pump of the invention, applied to a water-suction pump having two bag-type pump chambers.

In the second preferred embodiment of the invention depicted in FIG. 4, the tanks 8-1 and 8-2 are eliminated and the upper sides of the non-return valves 15-1 and 15-2 are connected directly to the outlets of the bags 6-1 and 6-2. In this arrangement, water is sucked into one of the bags 6-1 and 6-2 while water is being expelled to the condenser 2 from the other of the bags 6-1 and 6-2. Otherwise, the construction and operation of the pump is the same as that of the first embodiment of FIG. 3.

Figure 5:
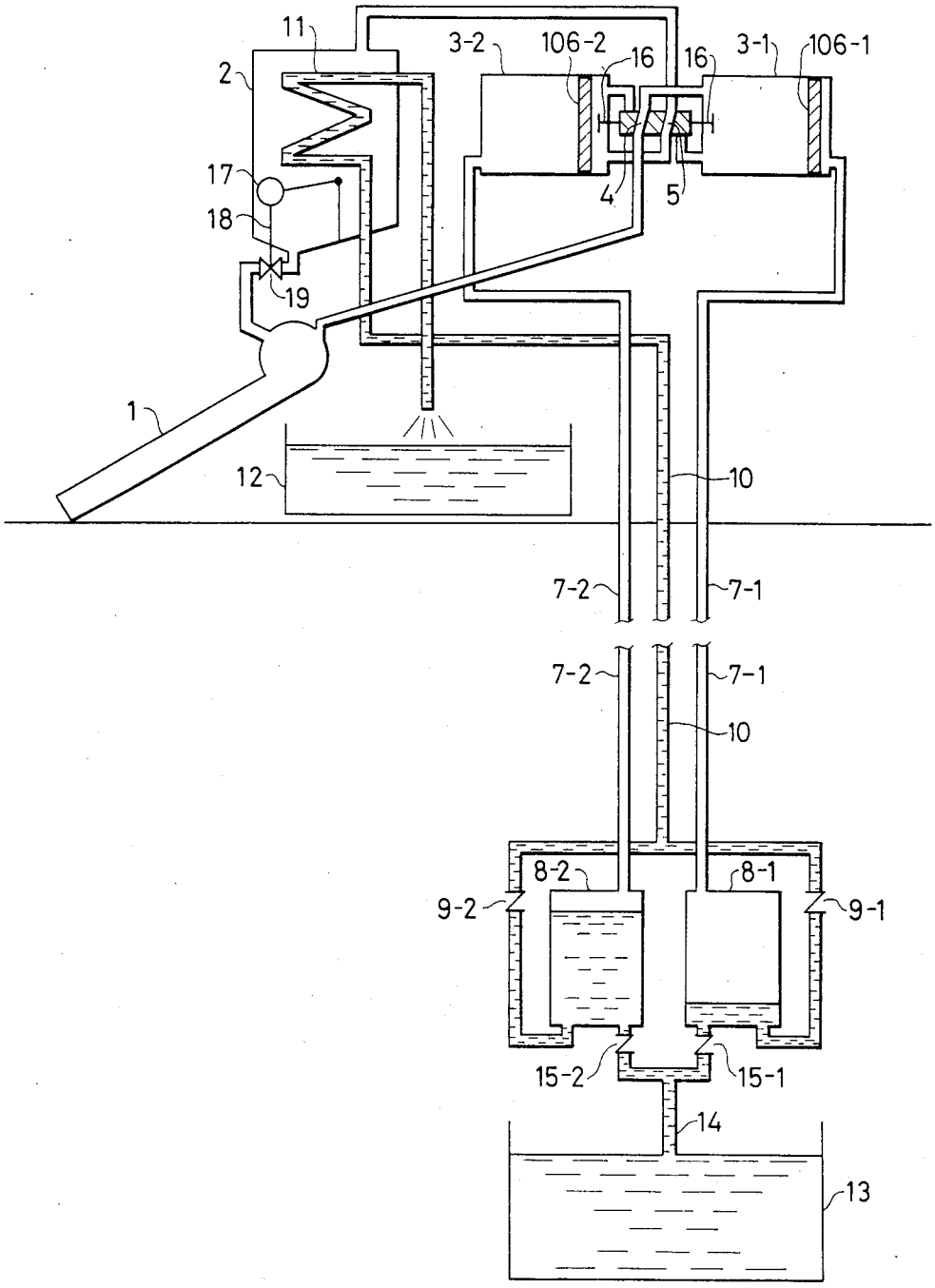
FIG. 5 is a schematic diagram of a third embodiment of a temperature-difference-actuated pump of the invention, applied to a gas-compression pump having two piston-type pump chambers.

The third embodiment shown in FIG. 5 is essentially the same as that of FIG. 3 except that the bags have been replaced by pistons 106-1 and 106-2. The advantages of this embodiment are the same as those of the FIG. 3 embodiment, including the fact that the vertical distance between the tank 13 and the pump chambers 3-1 and 3-2 is not limited by the atmospheric pressure.

Figure 6:
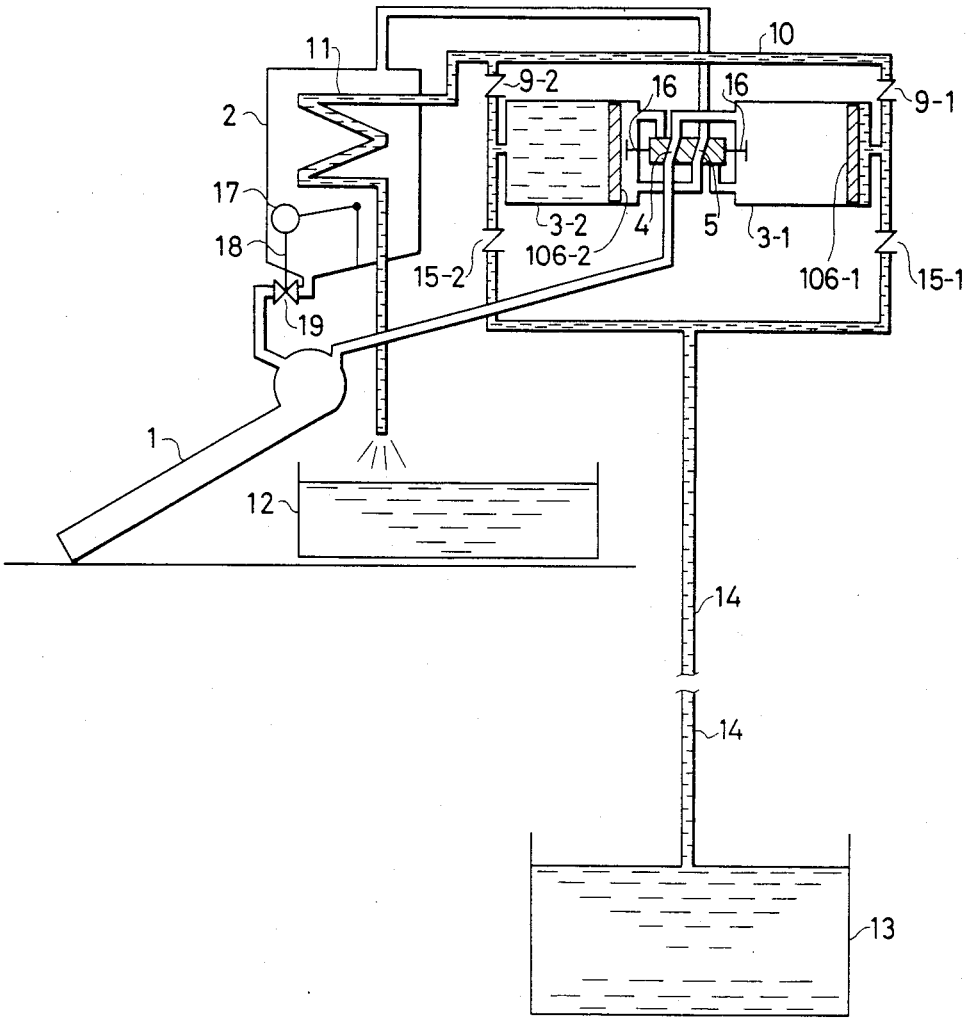
FIG. 6 is a schematic diagram of a fourth embodiment of a temperature-difference-actuated pump of the invention, applied to a water-suction pump having two piston-type pump chambers.

The fourth embodiment shown in FIG. 6 is similar to that of FIG. 4 except that the bags have been replaced by pistons 106-1 and 106-2.

If desired, in any of the above-described embodiments, a float valve 19 having a float 17 can be provided to control the flow of excess condensed working fluid to the boiler 1 from the condenser 2.

Figure 7:
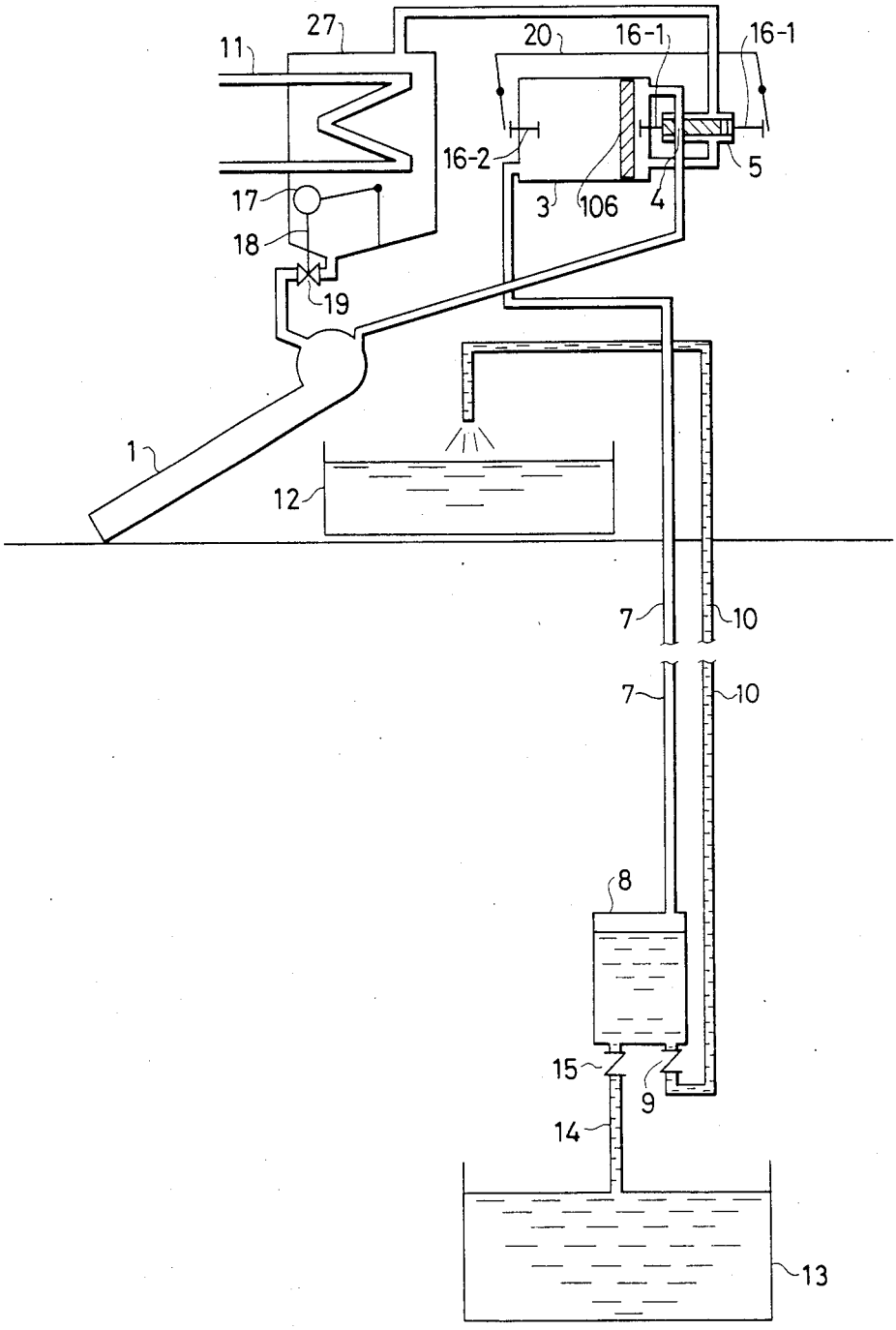
FIG. 7 is a schematic diagram of a fifth embodiment of a temperature-difference-actuated pump of the invention, applied to a gas-compression pump having a single piston-type pump chamber.

FIG. 7 shows a fifth embodiment of the invention in which only a single pump chamber 3 is employed. A piston 106 is slidably mounted in the chamber 3. The left side of the chamber 3 is communicated through a pipe 7 with the upper end of a tank 8, the lower end of which is communicated with the supply tank 13 through non-return valve 15 and with the receiving tank 12 via a non-return valve 9 and a pipe 10. Valves 4 and 5 are provided, which may be the same as used in the FIG. 3 embodiment. An actuation shaft 16-1 extends to both sides of the valves 4 and 5 and through the right wall of the chamber 3, and a second actuaion shaft 16-2 extends through the left wall of the chamber 3. The shafts 16-1 and 16-2 are connected with a rod 20.

In operation, when the piston is in the right-hand position as indicated in FIG. 7, the valve 4 is opened to connect the volume to the right of the piston 106 to the outlet of the boiler 1. Upon receiving high pressure vaperized working fluid from the boiler 1, the piston is pushed to the left, forcing air into the tank 8 and water from the tank 8 into the receiving tank 12 through the pipe 10. When the piston 106 reaches its leftmost position, the shaft 16-2 is pushed to the left, closing the valve 4 and opening the valve 5. The volume to the right of the piston 106 is then connected to the condenser 27. The working fluid expelled from this volume and condensed in the condenser 27. Thus, the pressure on the right side of the piston 106 is reduced, causing the piston to again move to the right. During the movement to the right, air is pulled into the volume to the left of the piston, lowering the pressure in the tank and pulling water thereinto from the supply tank 13. When the piston reaches its rightmost position, the shaft 16-1 is pushed to the right, closing the valve 5 and opening the valve 4. The cycle is then repeated.

If desired, the water flow through the pipe 10 can be routed through the cooling coil 11 of the condenser 27, or a second pump unit can be provided to supply the cooling water. Otherwise, an external cooling source can be employed.

It is to be noted that in all of the embodiments described above there are no electrically operated valves or components of any kind, thus making the various embodiments of the pumps of the invention suitable for use in applications where electricity is not available.

Specific examples of pumps constructed in accordance with the present invention will now be discussed.

EXAMPLE 1

A pump shown in FIG. 3 was constructed. In this pump, the working fluid was monofluorotrichloromethane, and the boiler was such that the working fluid was heated to a temperature of 37° C. The pump chambers had volumes of 1200 cc, and the bags, which were made of polyethylene, each had a maximum (inflated) inner volume of 1000 cc. The water in the supply tank was at a temperature of 11° C., and the vertical distance between the supply and the receiving tanks was 3 m. Air was used inside the bags. The air pipes (7-1 and 7-2) were copper tubes having an inner diameter of 5 mm, and for the water carrying pipes (10 and 14), copper pipes having an inner diameter of 17 mm were employed. For the condenser, a copper spiral pipe having an outer diameter of 6 mm and a length of 20 m was used. The control valves (4 and 5) were MASTER valves type RB532-3AD manufactured by Taiyo Iron Works Co., Ltd., of Japan. With this arrangement, 350 kg of water per hour could be pumped between the supply tank and the receiving tank.

EXAMPLE 2

A pump of the type shown in FIG. 4 was constructed. The pump chambers, valves and piping were the same as in Example 1. For a vertical distance between supply and receiving chambers of 4 m, 620 kg of water per hour could be pumped, while for a vertical distance of 5 m, 400 kg per hour could be pumped.

This completes the description of the preferred embodiments of the invention. Although preferred embodiments have been described, it is believed that numerous modifications and alterations thereto would be apparent to one of ordinary skill in the art without departing from the spirit and scope of the invention.

I claim:

1. A temperature-difference-actuated pump comprising: a boiler supplied with a working fluid; a condenser; a pump chamber; a pumping element disposed in said pump chamber; means for connecting said pump chamber to a source of a fluid to be pumped and a receiving receptacle in such a manner that repetitive movement of said pumping element pumps said fluid to be pumped from said source to said receptacle; valve means connecting said boiler, condenser and pump chamber to one another for controlling the flow of said working fluid among said boiler, condenser and pump; means for operating said valve means by movement of the pumping element and which respond to pressure changes in said pump chamber; means for automatically controlling the flow of excess condensed working fluid in said condenser into said boiler; and supply of a noncondensable gas operatively disposed with said pumping element and said fluid to be pumped.

2. The temperature-difference-actuated pump of claim 1, wherein said pumping element comprises a flexible bag.

3. The temperature-difference-actuated pump of claim 1, wherein said pumping element comprises a piston.

4. A temperature-difference-actuated pump comprising: first and second pump chambers; first and second pumping elements disclosed inside said first and second pump chambers, respectively, dividing said first and second pump chambers each into first and second complementarily variable volumes; a boiler; a condenser; valve means having a control element disposed to be operated by movement of at least one of said pumping elements for selectively connecting said first volumes to respective ones of said boiler and condenser, wherein, for a first position of said valve means, said first volume of said first pump chamber is connected to said boiler and said first volume of said second pump chamber is connected to said condenser, and for a second position of said valve means, said first volume of said first pump chamber is connected to said condenser and said first volume of said second pump chamber is connected to said boiler; means for performing a pumping operation in response to pressure changes in said second volumes of said pump chambers; means for automatically controlling the flow of excess condensed working fluid in said condenser into said boiler; and supply of a noncondensable gas operatively disposed with said first and second pumping elements and said fluid to be pumped.

5. The temperature-difference-actuated pump of claim 4, wherein said pumping elements each comprise a flexible bag.

6. The temperature-difference-actuated pump of claim 4, wherein said pumping elements each comprise a piston slidably mounted in the respective pump chamber.

7. The temperature-difference-actuated pump of claim 4, wherein said operating element of said valve means comprises a shaft extending into each of said pump chambers.

8. The temperature-difference-actuated pump of claim 4, wherein said means for performing a pumping operation comprises first and second tanks; first and second non-return valves, respectively, disposed between said tanks and said supply of said fluid to be pumped; third and fourth non-return valves connected between said tanks and a cooling coil of said condenser; and first and second pipes for connecting said second volumes of said first and second pump chambers, respectively, to said first and second tanks, respectively.

9. The temperature-difference-actuated pump of claim 1, wherein said means for connecting said pump chamber to a source of a fluid to be pumped comprises a tank; a first non-return valve connected between said tank and a supply of a fluid to be pumped; a second non-return valve connected between said tank and a receiving receptacle; a pipe connecting said tank to said pump chamber; valve means having first and second valve sections, said first valve section being open when said second valve is closed and vice versa, said first valve section being connected between said second volume and said boiler and said second valve section being connected between said second volume and said condenser; and means for working said valve in synchronization with movement of said piston in said pump chamber.

* * * * *